US012654926B2

(12) United States Patent
Pisarevsky

(10) Patent No.: US 12,654,926 B2
(45) Date of Patent: Jun. 16, 2026

(54) INSULATED CONTAINER APPARATUSES AND DEVICES

(71) Applicant: ADNART INC., Montreal (CA)

(72) Inventor: Arie Pisarevsky, Montreal (CA)

( * ) Notice: Subject to any disclaimer, the term of this patent is extended or adjusted under 35 U.S.C. 154(b) by 34 days.

(21) Appl. No.: 17/947,126

(22) Filed: Sep. 18, 2022

(65) Prior Publication Data

US 2023/0018181 A1 Jan. 19, 2023

Related U.S. Application Data

(63) Continuation-in-part of application No. 17/828,056, filed on May 31, 2022, now abandoned, which is a continuation of application No. PCT/IB2022/050178, filed on Jan. 11, 2022.

(60) Provisional application No. 63/137,172, filed on Jan. 14, 2021.

(51) Int. Cl.
*B65D 81/38* (2006.01)
*B65D 43/02* (2006.01)
*B65D 47/06* (2006.01)

(52) U.S. Cl.
CPC ..... *B65D 81/3874* (2013.01); *B65D 43/0231* (2013.01); *B65D 47/06* (2013.01); *B65D 81/3867* (2013.01); *B65D 81/3869* (2013.01); *B65D 2543/00537* (2013.01)

(58) Field of Classification Search
CPC ..... B65D 81/3876; B65D 81/3881; A47G 23/02; A47G 23/0216; A47G 2023/0275; A47G 2023/0283
See application file for complete search history.

(56) References Cited

U.S. PATENT DOCUMENTS

2014/0263368 A1* 9/2014 Booska ..... B65D 81/3484 220/592.17
2014/0319158 A1* 10/2014 Lonsway ..... B65D 81/3886 220/739
2018/0086540 A1* 3/2018 Haas ..... B65D 25/54
2019/0009972 A1* 1/2019 Spivey ..... B65D 81/3876
2022/0135314 A1* 5/2022 Ke ..... B65D 81/3841 220/739
2022/0204213 A1* 6/2022 Cheng ..... A47G 23/04

* cited by examiner

*Primary Examiner* — Javier A Pagan
(74) *Attorney, Agent, or Firm* — AlphaPatent Associates Ltd.; Daniel J. Swirsky

(57) ABSTRACT

Apparatuses and devices for preventing heat transfer through fluids contained in a fluid container, a device of which includes an insulation system including a fluid container section for containing a liquid, a detachable insulation sleeve section for preventing heat transfer therethrough thereby maintaining temperature of the fluid contained within the fluid container, a lid section for preventing spillage of contents from the fluid container section, and optionally a straw for accessing those contents.

14 Claims, 12 Drawing Sheets

INSULATED CONTAINER APPARATUSES AND DEVICES

CROSS-REFERENCE TO RELATED APPLICATIONS

This application is a continuation-in-part application of U.S. patent application Ser. No. 17/828,056, filed May 31, 2022, which is a continuation of International Application No. PCT/IB2022/050178, filed Jan. 11, 2022, which claims priority and benefit from U.S. Provisional Patent Application No. 63/137,172, filed Jan. 14, 2021, the contents and disclosure of which are incorporated herein by reference in their entirety.

FIELD

The invention relates generally to containers containing fluids such as beverages. More specifically, the invention relates to insulated container apparatuses and devices.

BACKGROUND

Fluids such as beverages like tea, coffee or wines are always poured in different types of containers such as glasses, cups, mugs, wine glass, and so on for consumption. These days, manufacturers thereof tend to provide aesthetic view to such containers as the consumers serve the drinks or fluids in such containers to the guests thereof. The fluids contained in the containers may sometimes be served as hot or too cold.

There may be some challenges faced by the user/guests consuming the drinks/fluids while holding the container. For example, cold wine while served in wine glass may develop water droplets on the outer walls of the wine glass, causing wetness to hands of the user and hence discomfort thereto. People usually talk while holding the drinks and the coldness of the drink may subside by transfer of heat from hand of the user to the wine glass, thereby reducing the taste as it is no longer cold and not enjoyable. Similarly, the coldness from the drink may transfer to hands of the user holding the wine glass, causing discomfort thereto. Hence, it is required to maintain the temperature of the cold drinks when served in different containers such as wine glass. Likewise serving cold shakes in glasses and consuming may face challenges as that aforesaid.

In similar instances, a hot beverage may be served in a cup or a glass heating the outer walls of the container, thereby causing discomfort to the hand of the user holding the container. Sometimes, the container and the hot fluids contained therein may fall down out of sudden from hands of the user if the walls of the container are too hot. Hence, there is a need of insulating the containers in both the cases of hot and liquid fluids contained in the container.

Conventionally, the consumers used to hold the containers with a piece of cloth or tissue paper to avoid transfer of heat from hands to the drink in the container. Such conventional method is also used to avoid transferring coldness of the drink to the hands of the user. However, the method is not an appropriate solution and also gives an awkward look especially in social gatherings like parties.

Many liquid containers are available in the market which are manufactured to have insulated walls to prevent heat transfer with the liquid. Few other insulation mechanisms are available which prevents transfer of heat between the container and the drink/fluid. However, such insulated apparatuses are made up from a material which provides complete insulation to the container like a glass hiding the entire aesthetic view of the glass.

Moreover, many insulation mechanisms do not support the container tightly or safely. The container may slip and fall out of the insulating mechanism causing breakage and potential injury. The insulating mechanisms do not grip well to many beverage containers made of common materials and are therefore at risk for spill and breakage and injury.

Hence, there is a need for an insulation mechanism in which fits different sizes of the fluid containers which may be not adhere to currently available insulating mechanisms and without affecting aesthetic view thereof.

SUMMARY

The invention, in embodiments thereof, provides an insulation system for preventing heat transfer between a beverage and its environment. The insulation system may include a fluid container section for containing a liquid, a detachable insulation sleeve section for preventing heat transfer therethrough thereby maintaining temperature of the fluid contained within the fluid container, a lid section for preventing spillage of contents from the fluid container section, and optionally a straw for accessing those contents.

The fluid container section may include a sleeve coupling mechanism and a lid coupling mechanism. The insulation sleeve section may have a corresponding container coupling mechanism configured to engage the sleeve coupling mechanism such that the fluid container section is securely affixed thereto. The lid section may have a top coupling mechanism configured to engage the top coupling mechanism of the lid section such that the lid section is securely affixed thereto.

Where appropriate, the container coupling mechanism may include a first screw thread and the sleeve coupling mechanism comprises a second screw thread configured to engage with the first screw thread when the insulation sleeve section is turned in a clockwise direction about the fluid container section.

In other embodiments, the second screw thread configured to engage with the first screw thread when the insulation sleeve section is turned in an anti-clockwise direction about the fluid container section.

Additionally or alternatively, the lid coupling mechanism may include comprising a third screw thread and the top coupling mechanism comprises a fourth screw thread configured to engage with the third screw thread when the lid section is turned in a clockwise direction about the fluid container section.

In other embodiments, the fourth screw thread configured to engage with the third screw thread when the insulation sleeve section is turned in an anti-clockwise direction about the fluid container section.

Optionally, the fluid container section may comprise a shatter proof or durable plastic for example a bisphenol free plastic such as tritan or the like.

Additionally or alternatively, the fluid container section may be selected from a material such as glass, plastic, ceramic, stoneware, stainless steel, paper, wood or the like as well as combinations thereof.

The insulation sleeve section typically comprises a double wall enclosing an insulation cavity. The insulation cavity may contains a vacuum or alternatively may contain an insulating material selected from a group consisting of: trapped air, foam, polymer, aerogel and the like as well as combinations thereof. Where required, the insulation sleeve section further includes a bottom of at least one wall. The insulation sleeve section may be constructed from a hard material selected from a group consisting of one or more of metals, alloys, polypropylene, and/or combinations thereof.

Where appropriate, the lid section comprises a through-hole for providing access to fluid contents of the fluid container section, and a hole rim configured to grip a straw inserted through the through-hole.

Other aspects of the invention introduce an insulation system for preventing heat transfer between a beverage and its environment, the system including a fluid container section for containing a liquid, a detachable insulation sleeve section for preventing heat transfer therethrough thereby maintaining temperature of the fluid contained within the fluid container, and a lid section for preventing spillage of contents from the fluid container section. The fluid container section includes a sleeve coupling mechanism; and the insulation sleeve section includes a container coupling mechanism configured to engage the sleeve coupling mechanism such that the fluid container section is securely affixed thereto.

The lid section may include a through-hole for accommodating a straw therethrough. The lid section further comprises a hole rim configured to grip a straw inserted therethrough.

In various examples, the lid section may comprise a disk shaped cover and a descending rim. Accordingly, the descending rim may include a top coupling mechanism, such as a screw thread around an inner surface of the descending rim. Additionally or alternatively, the top coupling mechanism is selected from a group consisting of silicone rings, clips, clasps, zippers and combinations thereof.

BRIEF DESCRIPTION OF THE DRAWINGS

For a better understanding of the embodiments and to show how it may be carried into effect, reference will now be made, purely by way of example, to the accompanying drawings.

With specific reference now to the drawings in detail, it is stressed that the particulars shown are by way of example and for purposes of illustrative discussion of selected embodiments only, and are presented in the cause of providing what is believed to be the most useful and readily understood description of the principles and conceptual aspects. In this regard, no attempt is made to show structural details in more detail than is necessary for a fundamental understanding; the description taken with the drawings making apparent to those skilled in the art how the several selected embodiments may be put into practice.

As used in this specification, the singular indefinite articles "a", "an", and the definite article "the" should be considered to include or otherwise cover both single and plural referents unless the content clearly dictates otherwise. In other words, these articles are applicable to one or more referents. As used in this specification, the term "or" is generally employed to include or otherwise cover "and/or" unless the content clearly dictates otherwise.

Figure 1:
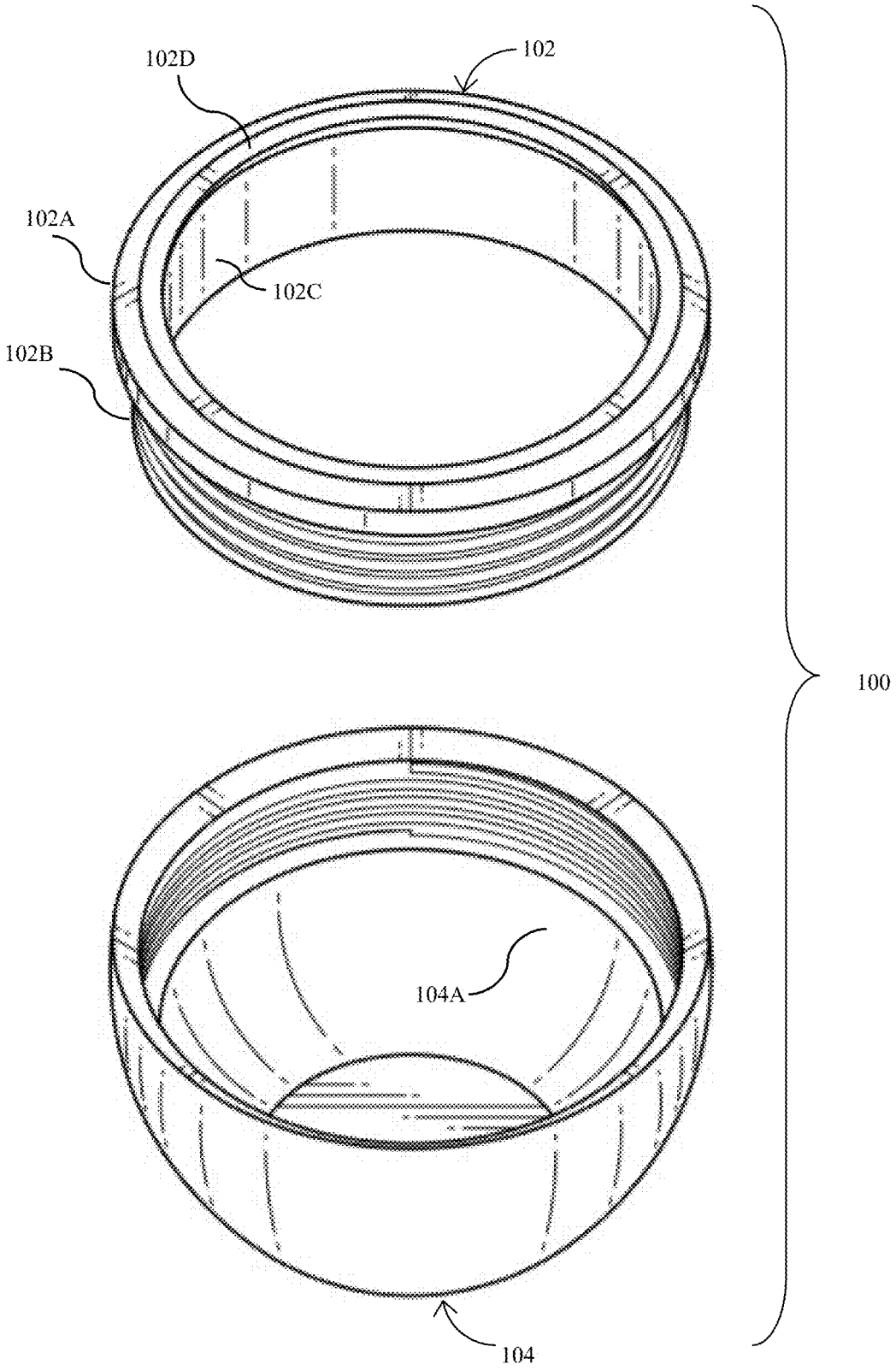
Figure 2:
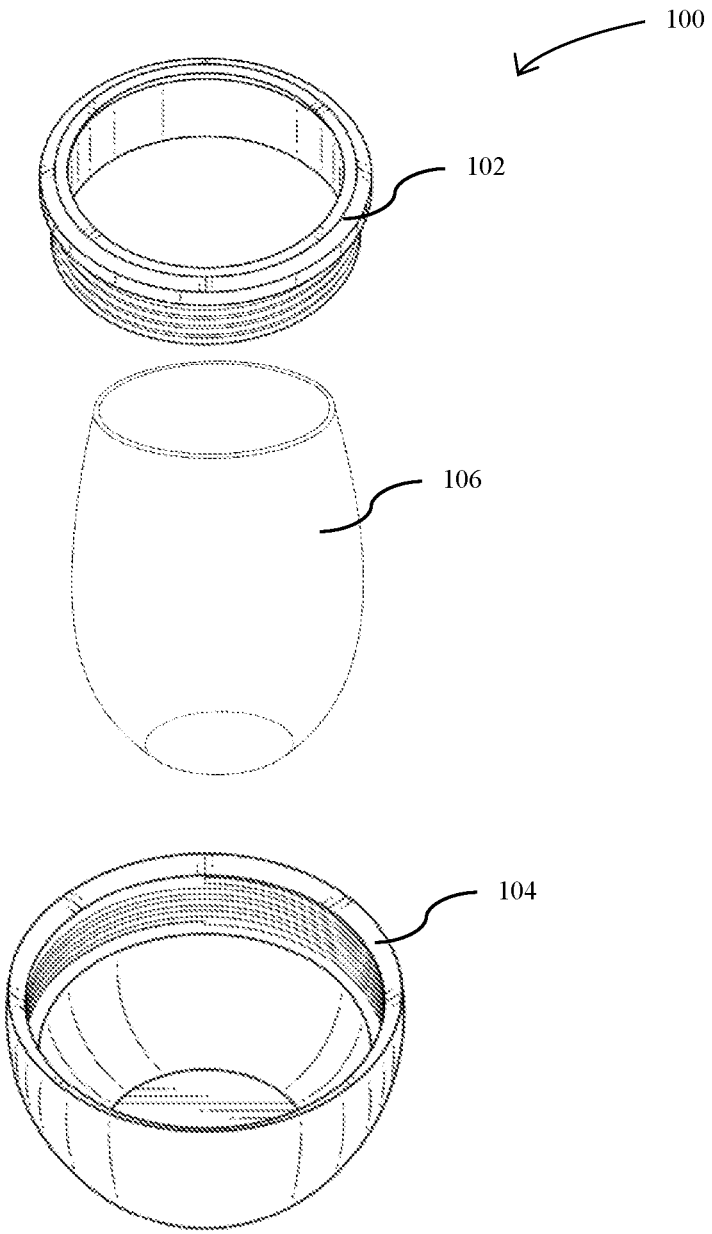
Figure 3:
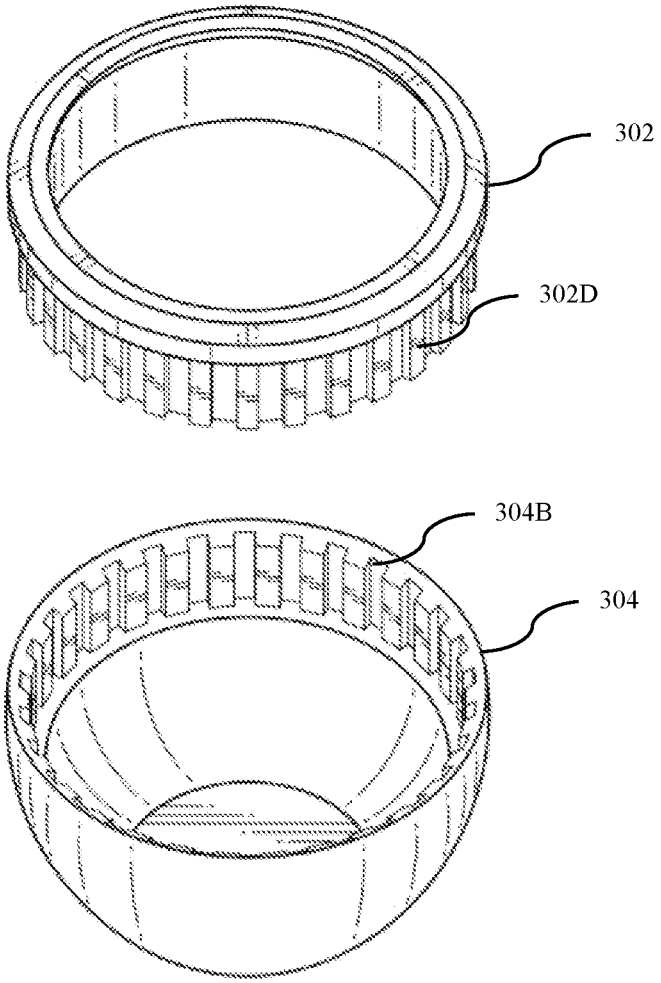
Figure 4:
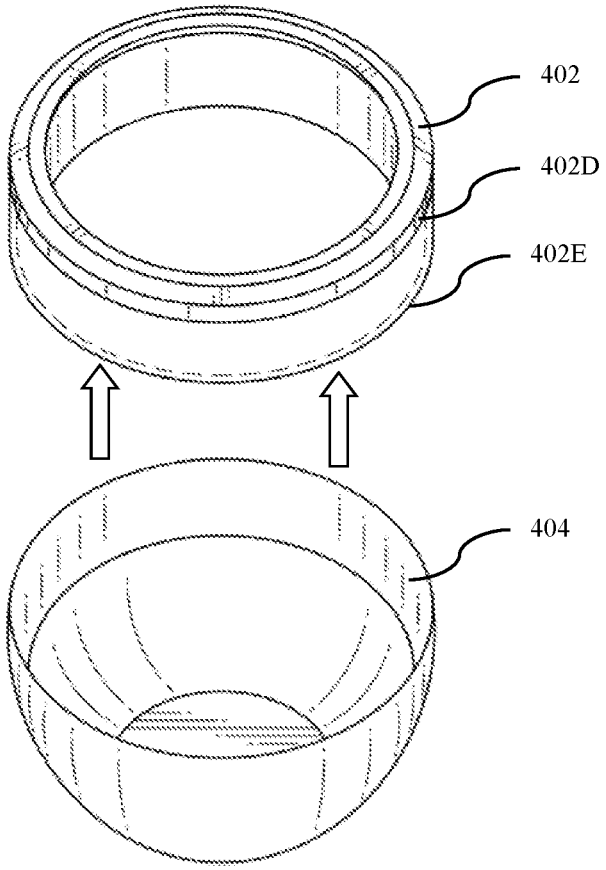
Figure 5:
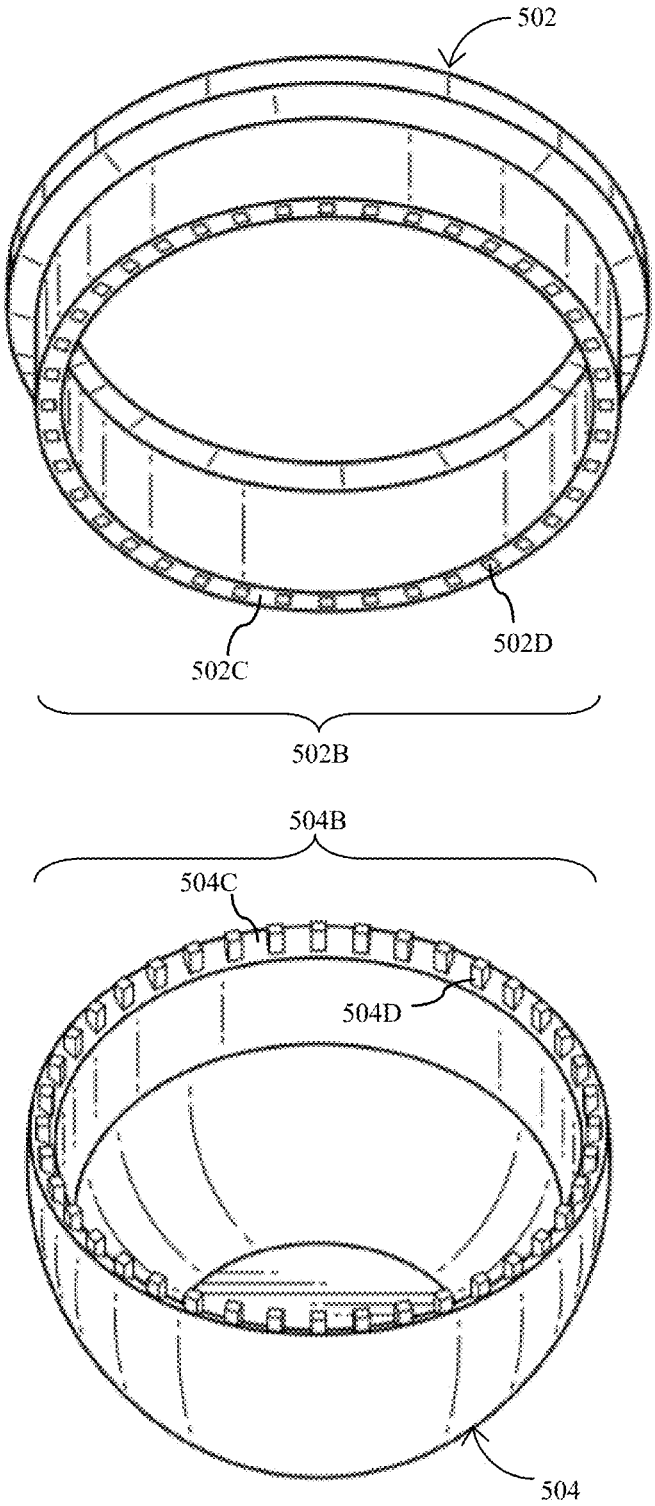
Figure 6A:
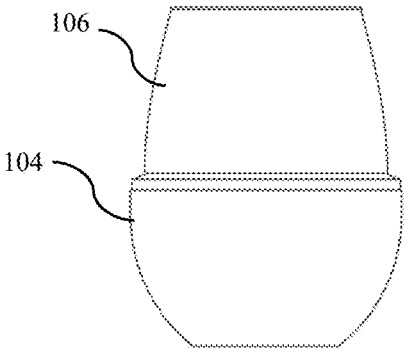
Figure 6B:
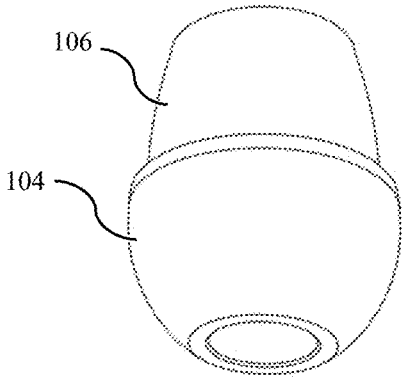
Figure 6C:
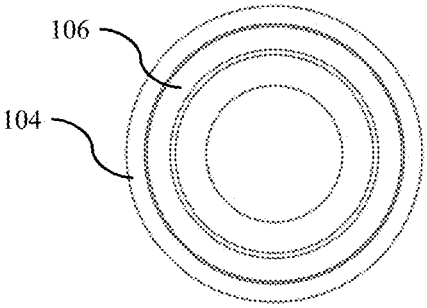
Figure 6D:
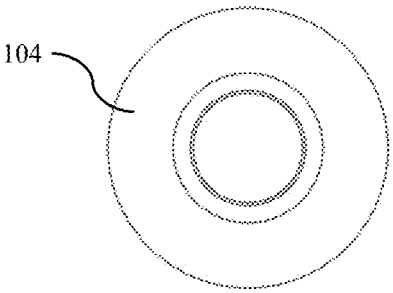
Figure 7A:
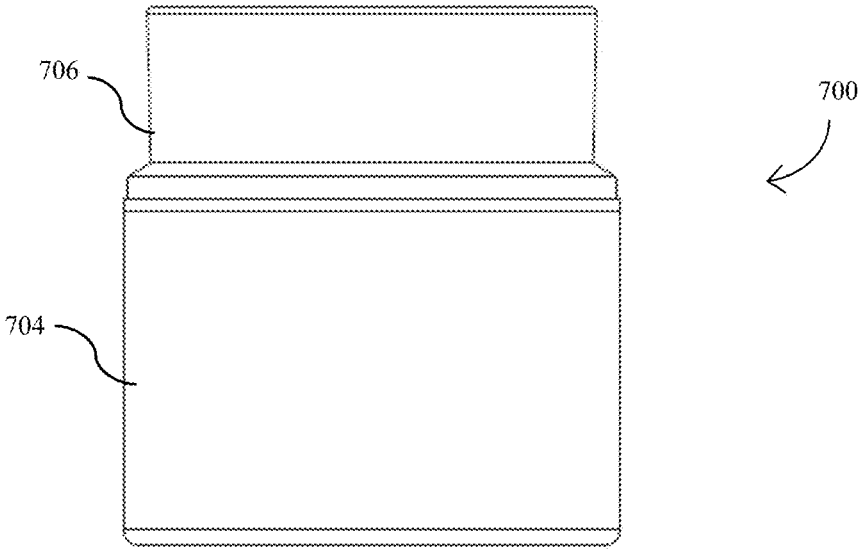
Figure 7B:
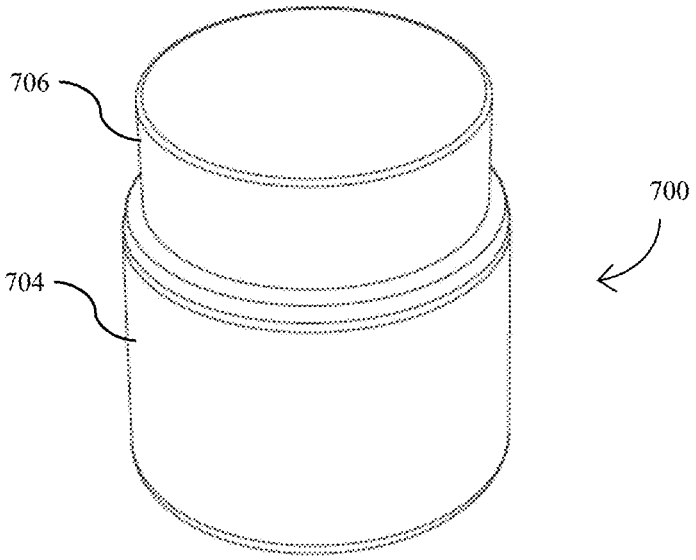
Figure 7C:
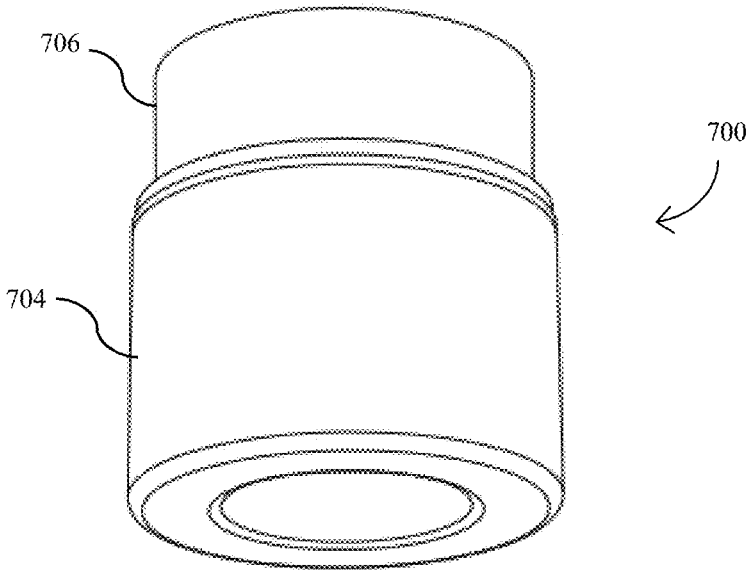
Figure 7D:
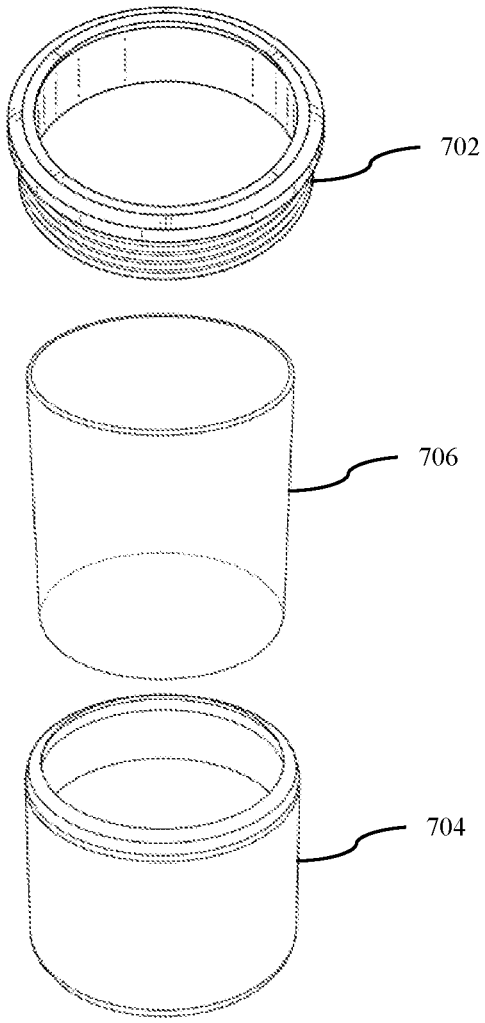
Figure 7E:
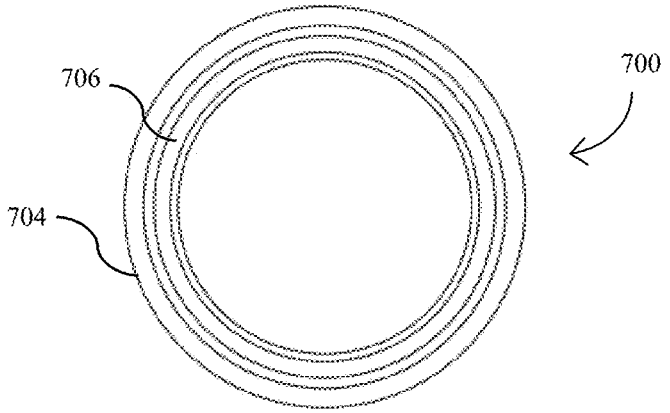
Figure 7F:
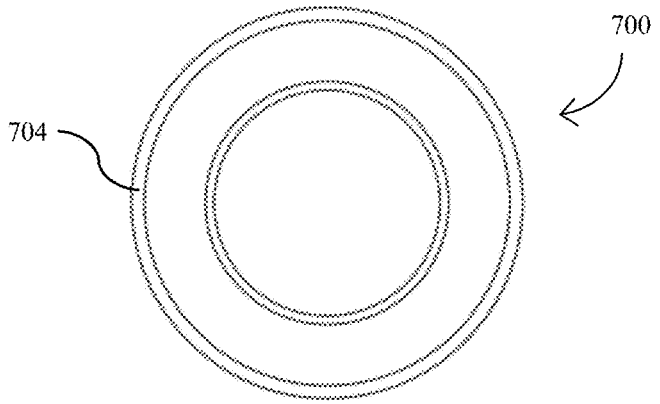
Figure 8A:
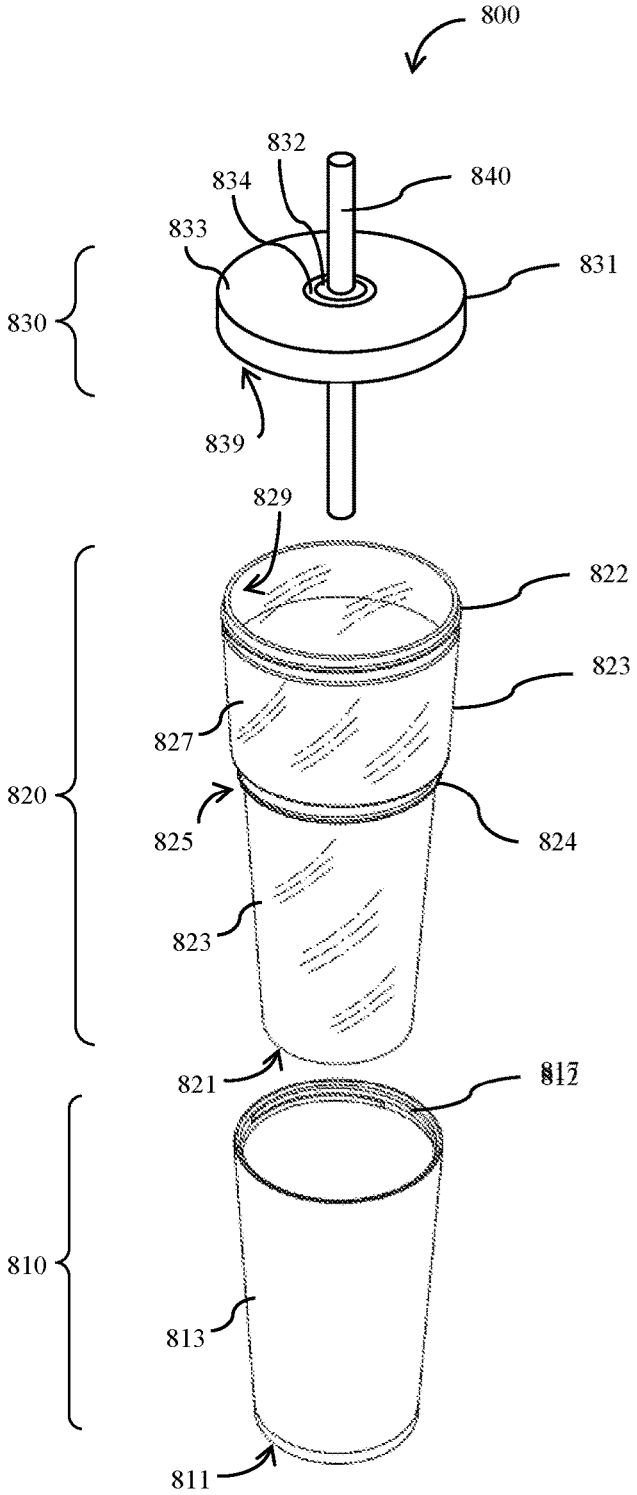
Figure 8B:
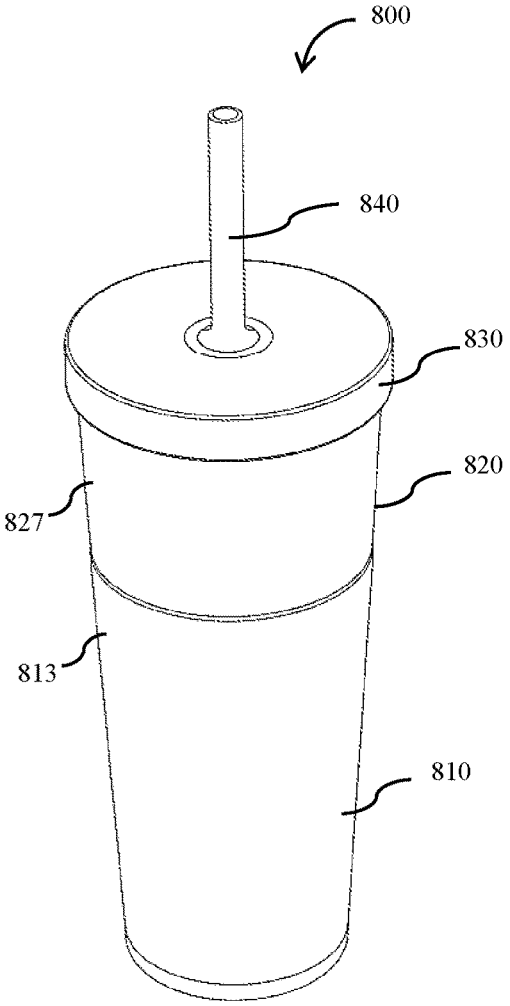
Figure 9A:
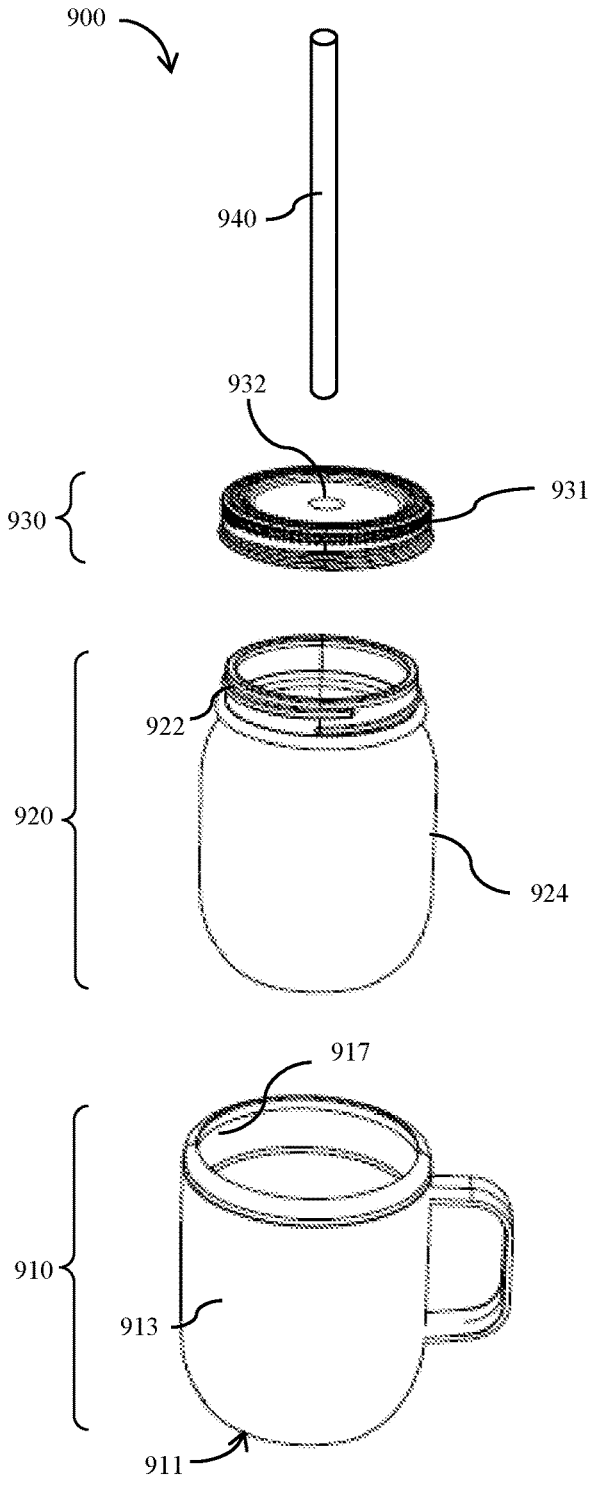
Figure 9B:
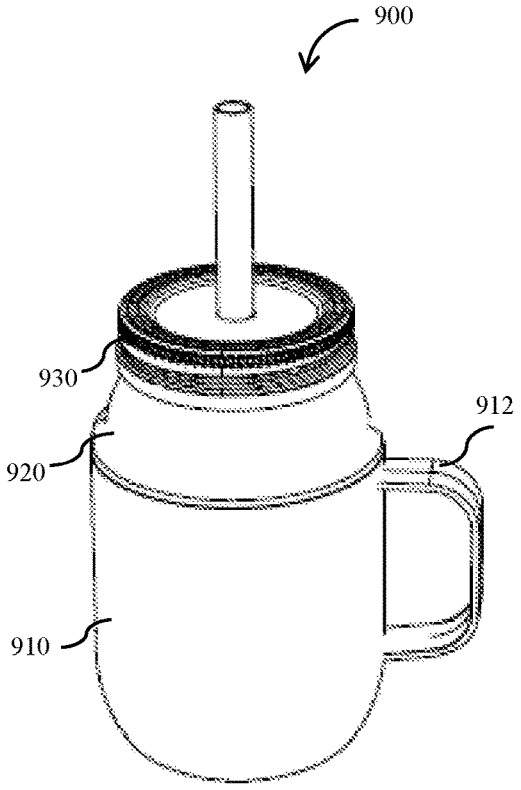

In the accompanying drawings:

FIG. 1 illustrates an insulation device 100 including a gripping ring 102 and an insulation sleeve 104;

FIG. 2 illustrates the insulation device 100 along with a container 106;

FIG. 3 illustrates another aspect of engagement of the gripping ring 302 with the insulation sleeve 304;

FIG. 4 illustrates yet another aspect of engagement of the gripping ring 402 with the insulation sleeve 404;

FIG. 5 illustrates another aspect of engagement of the gripping ring 502 with the insulation sleeve 504;

FIGS. 6A and 6B illustrate a front view and a side view, respectively, of an insulated glass container in accordance with an embodiment of the invention;

FIGS. 6C and 6D illustrate a top and a bottom view, respectively, of an insulated glass container in accordance with an embodiment of the invention;

FIG. 7A illustrates front view of another aspect of an insulated glass container 700;

FIGS. 7B and 7C illustrate exemplary side views of the insulated glass container 700;

FIG. 7D illustrates the separated parts of the insulated glass container 700;

FIGS. 7E and 7F illustrate the top view and the bottom view of the insulated glass container 700, respectively;

FIGS. 8A and 8B illustrate various elements of a further embodiment of a lidded insulated container 800; and FIGS. 9A and 9B illustrate various elements of a further embodiment of a lidded insulated mason jar 900.

DETAILED DESCRIPTION

Reference will now be made in detail to embodiments of the invention, examples of which are illustrated in the accompanying drawings.

FIG. 1 illustrates an insulation device 100 for insulating the containers (not shown in FIG. 1) containing fluids. The container can be a glass, a tumbler, a flask, a cup, a bottle and the like. The device 100 includes a gripping ring 102 and an insulation sleeve 104. The ring 102 is defined by a hollow member having a circular head 102A extended to be overhung by a portion 102B of smaller outer diameter as that of the head 102A such that the ring 102 is a T-shape. The ring 102 is flexible and adapted to fit waist of a container of different sizes. For example, the ring 102 is configured to grip a glass container 106 as shown in FIG. 2. The ring 102 is further also configured to couple with the sleeve 104.

Smooth glass such as used in glass containers is notoriously difficult to grip using typical materials. It is therefore a particular feature of embodiments of the gripping ring 102 that it may have an inner surface of a glass adhering material 102D such as a polymer, rubber, silicone, and/or combinations thereof.

The insulation sleeve 104 is configured to prevent heat transfer therethrough. Accordingly, the insulation sleeve 104 may include a double wall enclosing an insulation cavity. Optionally the insulation cavity within the double wall of the insulation sleeve may contain a vacuum, alternatively, the insulation cavity within the double wall of the insulation sleeve may contain an insulating material such as trapped air, foam, polymer, aerogel or a combination thereof.

The insulation sleeve 104 is further defined by a member that is configured to cover a part of the container 106. The part of the container 106 specifically defines the portion which is hold by a user consuming the drink/fluid from the container 106. The sleeve 104 can be of any shape depending upon the shape and size of the container 106 which will be discussed herein below in conjunction with preceding illustrations. As shown in FIG. 2, the sleeve 104 is devised of round shape to fit the round bottom portion of the container 106. As the ring 102 slides on to touch the waist of the container 106, the sleeve 104 is coupled with the ring 102 from the bottom. The sleeve 104 can engage with the ring 102 with any methods described in the art. It is contemplated that the embodiments and aspects thereof described herein below for coupling of the sleeve 104 with the ring 102 are merely exemplary for the persons skilled in the art to understand the invention.

In an aspect, an inner surface of the sleeve 104 includes a first coupling mechanism and an outer surface of the ring 102 includes a second coupling mechanism configured to couple with that of the first coupling mechanism. As shown in FIG. 1, the first coupling mechanism includes a plurality of screw threads 104A which are grooved on the inner surface of the sleeve 104 thereof to be engaged with the outer surface of the ring 102. The second coupling mechanism of the ring 102 also includes a plurality of screw threads 102C on the outer surface of the ring 102 disposed skirting the portion 102B thereof. The threads 104A and 102C are disposed such that both the threads 104A and 102C align with each other. For example, the threads 104A and 102C engage with each other when the sleeve 104 turns in a clockwise direction about the container 106 and the ring 102. In such a case, the ring 102 may firstly slide over the container 106, followed by the sleeve 104.

In some aspects, the threads 104A may be disposed on the outer surface of the sleeve 104 while the threads 102C may be disposed on inner portion of either of the head 102A. In the aspect, the threads 102C and 104A may engage with each other likewise. In such an aspect, the sleeve 104 may firstly slide over the container 106 from bottom, followed by the ring 102 from top. As the sleeve 104 and the ring 102 engage with each other, the sleeve 104 and the ring 102 cover a substantial lower portion of the container 106 which is hold by the user as shown in FIG. 6A. The side view of such an engagement can also be viewed in FIG. 6B. FIGS. 6C and 6D illustrate top and bottom view of the insulated glass container, respectively.

In some aspects, the ring 102 and the sleeve 104 may be devoid of any screw threads. A single-walled sleeve 104 may be disposed on the waist of the container 106 by slipping onto its outer surface. The ring 102 may then be inserted to snugly fit on the outer surface of the sleeve 104. The sleeve snugly fits between the outer wall of the container 106 and the inner surface of the ring 102.

FIG. 3 illustrates another aspect of engagement of the gripping ring 302 with the insulation sleeve 304. In the aspect, a pattern 302D may be embossed to skirt on the outer surface of the ring 302. Such a pattern may improve the grip of the ring by itself. Optionally, a similar pattern 304B may be engraved within the inner surface of the sleeve 304, where further security is required. Such patterns 302D and 304B form a male-female connector. These patterns may be of any design or shape. Examples of such patterns may include such as but are not limited to slits of any shape such as rectangular, triangular, circular, and so on.

In the exemplary embodiment of FIG. 3, the ring 302 may firstly slide over the container 306 from the top followed by the sleeve 304 from the bottom, or vice versa. The patterns 302D and 304B are configured to snap-fit with each other, thereby interlocking the sleeve 304 and the ring 302 over the glass container 306.

In an alternative aspect, the pattern may be embossed over the inner surface area of the ring 302 while the corresponding pattern may be engraved on the outer surface of the sleeve 304. Hence, in the above aspects, the patterns are configured to snap-fit with each other, thereby interlocking the sleeve 304 and the ring 302.

In another aspect as shown in FIG. 4, the gripping ring 402 is double walled having an outer wall 402D and an inner wall 402E such that there is a space between the two walls 402D and 402E defining a pocket sleeve of the ring 402. The walls 402D and 402E are open-ended from the bottom, hence defining a pocket sleeve including two walls. As the pocket sleeve is void, a single walled insulation sleeve 404 can just be inserted within the pocket sleeve of the ring 402 and may be engaged therein by suction of the walls 402D and 402E.

A further aspect of the invention is shown in FIG. 5 wherein the insulation sleeve 504 has a pattern 504B on its upper periphery of the surface 504C. The pattern 504B has small rectangular portions 504D protruding out from the surface 504C. The ring 502 has a correspondingly similar pattern 502B on the lower periphery of the surface 502C. The pattern 502B has small holes to accommodate the rectangular portions 504D of the insulation sleeve 504. Examples of the pattern may include such as but are not limited to an irregular matrix, slits, and any shape-oriented modules configured for connecting, and so on. The pattern 504B of the sleeve 504 may be configured to interlock with the pattern 502B of the ring 502 such that the two patterns snap-fit into each other.

In some embodiments, the liquid container 106 may be of any shape such as including but are not limited to square, rectangular, oval, and so on. An insulated glass container 700 of rectangular shape having the ring and the sleeve adapted thereto is shown in FIG. 7A which illustrate the front view of the insulated glass container 700. Exemplary side views of the insulated glass container 700 are shown in FIGS. 7B and 7C. FIG. 7D illustrate the separated parts of the insulated glass container 700 having a glass container 706, a gripping ring 702 and an insulation sleeve 704. The sleeve 704 is configured to insulate the entire bottom of the glass container 706. FIGS. 7E and 7F illustrates the top view and the bottom view of the insulated glass container 700, respectively.

In various embodiments, the gripping ring 102 may be made up of soft flexible materials selected from a group consisting of one or more of polymer, rubber, silicone, and/or combinations thereof. The insulation sleeve 104 may be constructed from hard materials selected from a group consisting of one or more of metals, alloys, polypropylene, and/or combinations thereof. In the above embodiments, the insulation mechanism of the gripping ring 102 and the insulation sleeve 104 may be configured to prevent heat transfer from the hands of the user to a cold liquid. Alternatively, the insulation mechanism may be configured to prevent heat transfer to the hands of the user from a hot liquid. The container 106 may be made from any material that is well known in the art. Examples of the materials may include such as but are not limited to glass, plastic, steel, stainless steel, aluminum, silver, and so on.

Referring now to FIGS. 8A and 8B a further embodiment of a lidded insulated container 800 is introduced. The lidded embodiment 800 of the insulated container includes a fluid container section 820, an insulation sleeve section 810, a lid section 830 and a drinking straw 840. The various elements of the insulated container 800 may be combined as shown in FIG. 8B to form a united whole with the insulation sleeve section 810 surrounding the fluid container section 820 and the lid section 830 covering the top of the fluid container section 820 with the straw 840 provided access to fluids contained within and through which contained fluids may be drunk.

The fluid container section 820 of the embodiment is configured to contain fluids within an internal volume bounded by a base 821 and an internal sidewall 829. When the lid 830 is removed, contents may be introduced into the internal volume via the open top.

Accordingly, the sidewall and base 821 are made from a non-porous materials such that fluids cannot pass therethrough. For example, the fluid container section 820 may be constructed from glass, plastic, ceramic, stoneware, stainless steel, paper, wood or the like as well as combinations thereof.

In particular embodiments, the fluid container section 820 is formed from a shatter proof or durable plastic for example a bisphenol free plastic such as tritan or the like.

Where appropriate the fluid container section 820 may be formed as a single piece of material alternatively a separate base section may be attached to sidewall and the seam sealed to prevent leakage.

It is a particular feature of embodiments of the fluid container 820 that it includes a lid coupling mechanism 822 for attaching the lid 830 thereto thereby closing the open top and preventing contained fluids from spilling out. The lid coupling mechanism 822 may be configured to couple with a corresponding top coupling mechanism on the lid section 830. In some examples the lid coupling mechanism 822 is a screw thread formed upon the upper outer surface 827 of the side wall and is configured to screw into a corresponding screw thread 839 formed around the inner surface of a descending rim 831 of the lid section 830. It will be appreciated that other coupling mechanisms such as silicone rings, fasteners, hook-and-eye systems, Velcro®, clips, clasps, zippers and the like may be used to attach the fluid container 820 to the lid section 830 as appropriate.

It is another feature of embodiments of the fluid container section 820 that a sleeve coupling mechanism 824 may be provided for attaching the insulating sleeve 810 to the fluid container section 820 thereby securely affixing the insulation sleeve thereto. The sleeve coupling mechanism 824 may be configured to couple with a corresponding coupling mechanism on the insulation sleeve section 810. In some examples the sleeve coupling mechanism 824 is a screw thread formed around the middle section 825 of the side wall and is configured to screw into a corresponding screw thread 817 formed upon the inner surface of the insulating sleeve section 810. It will be appreciated that other coupling mechanisms such as silicone rings, fasteners, hook-and-eye systems, Velcro®, clips, clasps, zippers and the like may be used to attach the fluid container section 820 to the insulating sleeve section 810 as appropriate.

The insulation sleeve section 810 includes a base 811 and a side wall 813 which prevent heat transfer therethrough. Accordingly, the insulation sleeve section 810 may include a double wall enclosing an insulation cavity. Optionally the insulation cavity within the double wall of the insulation sleeve may contain a vacuum, alternatively, the insulation cavity within the double wall of the insulation sleeve may contain an insulating material such as trapped air, foam, polymer, aerogel or a combination thereof.

The insulation sleeve section 810 may include a container coupling mechanism 817 such as a screw thread or the like configured to engage with the corresponding sleeve coupling mechanism 824 of the fluid container section 820. It will be appreciated that other coupling mechanisms such as silicone rings, fasteners, hook-and-eye systems, Velcro®, clips, clasps, zippers and the like may be used to attach the fluid container section 820 to the insulating sleeve section 810 as appropriate.

Referring to the united whole 800 illustrated in FIG. 8B, it is noted that, where appropriate, the surface of the outer side wall 813 of the insulation sleeve 810 may be flush with the upper outer surface 827. Such a configuration is easier to grip and may also be considered more aesthetically pleasing. Accordingly, certain embodiments of the fluid container section 820 have a stepped outer side wall having a stepped waist 825 joining a lower outer surface 823 and the upper outer surface 827. In this manner the diameter of the lower outer surface 823 may be selected to match the inner surface of the insulation sleave section 820.

The lid section 830 includes a disk shaped cover 833 having a descending rim 831. When the lid section 830 is coupled to the fluid container section, the disk shaped cover 833 may prevent spillage of fluid contents from the fluid container section 820. The descending rim 831 may provide a top coupling mechanism 839 for engaging the lid section 830 securely to the top of the fluid container section 820.

It is further noted that the lid section 830 may further prevent heat transfer from the fluid contents. Accordingly, the lid section may include an insulation cavity contained within a double wall.

It is a particular feature of the lid section 830 that it includes a central through-hole 832 through which the straw 840 may be passed. Accordingly, when the lid section 830 is attached to the fluid container section 820, a straw 840 passed through the through-hole 832 may provide access to the fluid contents of the fluid container section 820. Where required a through hole rim 834, for example of silicone of the like, may be provided to close, at least partially, the through hole when the straw 840 is not inserted and optionally to grip the straw 840 securely when the straw is inserted therein.

Referring now to FIGS. 9A and 9B a further embodiment of a lidded insulated mason jar 900 is introduced. The mason-jar embodiment 900 of the insulated container includes a fluid container section 920, an insulation sleeve section 910, a lid section 930 and a drinking straw 940. The various elements of the mason jar 900 may be combined as shown in FIG. 8B to form a united whole with the insulation sleeve section 910 surrounding the fluid container section 920 and the lid section 930 covering the top of the fluid container section 920 with the straw 940 provided access to fluids contained within and through which contained fluids may be drunk.

The insulation sleeve section 910 includes a base 911 and a side wall 913 which prevent heat transfer therethrough. It is a particular feature of the insulation sleeve section 910 of the mason jar embodiment 900 that it includes a handle section 912 extending from its side wall 913. As with other embodiments described herein, the insulation sleeve section 910 may include a double wall enclosing an insulation cavity. Optionally the insulation cavity within the double wall of the insulation sleeve may contain a vacuum, alternatively, the insulation cavity within the double wall of the insulation sleeve may contain an insulating material such as trapped air, foam, polymer, aerogel or a combination thereof.

The insulation sleeve section 910 of the mason jar may include a container coupling mechanism 917 such as a screw thread or the like configured to engage with the fluid container section 920. It will be appreciated that other coupling mechanisms such as silicone rings, fasteners, hook-and-eye systems, Velcro®, clips, clasps, zippers and the like may be used to attach the fluid container section 920 to the insulating sleeve section 910 as appropriate.

The fluid container section 920 of the embodiment is configured to contain fluids within an internal volume bounded by a base and a sidewall 924. When the lid 930 is removed, contents may be introduced into the internal volume via the open top. Accordingly, the sidewall and base of the fluid container 920 are made from a non-porous materials such that fluids cannot pass therethrough. For example, the fluid container section 920 may be constructed from glass, plastic, ceramic, stoneware, stainless steel, paper, wood or the like as well as combinations thereof. Where appropriate the fluid container section 920 may be formed as a single piece of material alternatively a separate base section may be attached to sidewall and the seam sealed to prevent leakage.

It is a particular feature of embodiments of the fluid container 920 that it includes a lid coupling mechanism 922 for attaching the lid 930 thereto thereby closing the open top and preventing contained fluids from spilling out. The lid coupling mechanism 922 may be configured to couple with a corresponding top coupling mechanism on the lid section 930. In some examples the lid coupling mechanism 922 is a screw thread formed upon the upper outer and is configured to screw into a corresponding screw thread formed around the inner surface of a descending rim 931 of the lid section 930. It will be appreciated that other coupling mechanisms such as silicone rings, fasteners, hook-and-eye systems, Velcro®, clips, clasps, zippers and the like may be used to attach the fluid container 920 to the lid section 930 as appropriate.

It is a particular feature of the lid section 930 that it includes a central through-hole 932 through which the straw 940 may be passed. Accordingly, when the lid section 930 is attached to the fluid container section 920, a straw 940 passed through the through-hole 932 may provide access to the fluid contents of the fluid container section 920.

While embodiments of the invention have been disclosed in the above detailed description, the invention is not limited thereto. As will be readily apparent to those skilled in the art, the invention may easily be produced in other specific forms without departing from its essential characteristics. The present embodiments are, therefore, to be considered as merely illustrative and not restrictive, and all changes which come within therefore intended to be embraced therein.

What is claimed is:

1. An insulated container apparatus for preventing heat transfer through fluids, the insulated container comprising:

a fluid container configured for containing fluids having different temperature than the fluid container, the fluid container having a waist;

an insulation sleeve having at least one wall; and a flexible gripping ring having:

an inner surface configured to grip the waist of the fluid container by friction between its inner surface and the waist of the fluid container; and an outer surface configured to couple with an inner surface of the insulation sleeve, wherein the inner surface of the insulation sleeve comprises a first screw thread and the outer surface of the gripping ring comprises a second screw thread configured to couple with the first screw thread.

2. The apparatus of claim 1, wherein the fluid container may be a glass, a tumbler, a flask, a cup, or a bottle.

3. The apparatus of claim 1, wherein the inner surface of the insulation sleeve includes a first coupling mechanism, and the outer surface of the gripping ring includes a second coupling mechanism configured to couple with the first coupling mechanism of the insulation sleeve.

4. The apparatus of claim 3, wherein the first coupling mechanism comprises a first screw thread and the second coupling mechanism comprises a second screw thread configured to engage with the first screw thread when the sleeve is turned in a clockwise direction about the fluid container.

5. The apparatus of claim 1, wherein the fluid is either cold or hot as compared to the fluid container and wherein the heat transfer takes place to or from the fluid, respectively.

6. The apparatus of claim 1, wherein the insulation sleeve further includes a bottom of at least one wall.

7. The apparatus of claim 1, wherein the insulation sleeve is constructed from a hard material selected from a group consisting of one or more of metals, alloys, polypropylene, and/or combinations thereof.

8. The apparatus of claim 1, wherein the gripping ring is constructed from a soft flexible material selected from a group consisting of one or more of polymer, rubber, silicone, and/or combinations thereof.

9. The apparatus of claim 1 configured to insulate a glass container wherein said inner surface of said gripping ring is constructed of a glass adhering material.

10. The apparatus of claim 1 wherein said insulation sleeve comprising a double wall enclosing an insulation cavity.

11. The apparatus of claim 10 wherein said insulation cavity contains a vacuum.

12. The apparatus of claim 10 wherein said insulation cavity contains an insulating material selected from a group consisting of: trapped air, foam, polymer, aerogel or a combination thereof.

13. The apparatus of claim 1, wherein the gripping ring comprises a T-shape ring.

14. The apparatus of claim 1, wherein the gripping ring comprises a circular head overhung by an inner portion of smaller outer diameter.

* * * * *